US007004684B2

(12) United States Patent
Fox

(10) Patent No.: US 7,004,684 B2
(45) Date of Patent: Feb. 28, 2006

(54) METHOD FOR CONSTRUCTION OF PIERS IN SOIL AND A PIER CONSTRUCTION

(75) Inventor: Nathaniel S. Fox, Paradise Valley, AZ (US)

(73) Assignee: Geotechnical Reinforcement, Inc., Las Vegas, NV (US)

( * ) Notice: Subject to any disclaimer, the term of this patent is extended or adjusted under 35 U.S.C. 154(b) by 0 days.

(21) Appl. No.: 10/493,529

(22) PCT Filed: Dec. 5, 2003

(86) PCT No.: PCT/US03/38766

§ 371 (c)(1),
(2), (4) Date: Aug. 4, 2004

(87) PCT Pub. No.: WO2004/053237

PCT Pub. Date: Jun. 24, 2004

(65) Prior Publication Data

US 2004/0247397 A1 Dec. 9, 2004

Related U.S. Application Data

(60) Provisional application No. 60/431,269, filed on Dec. 6, 2002.

(51) Int. Cl.
*E02D 5/44* (2006.01)

(52) U.S. Cl. ..... 405/237; 405/233; 405/240; 405/244; 405/249; 175/263

(58) Field of Classification Search ..... 405/232, 405/233, 237, 238, 240, 244, 249, 269; 175/263; 52/741.15

See application file for complete search history.

(56) References Cited

U.S. PATENT DOCUMENTS

| | | | | |
|---|---|---|---|---|
| 1,443,306 A | | 1/1923 | Blumenthal | |
| 1,477,567 A | | 12/1923 | Lancaster | |
| 2,729,067 A | | 1/1956 | Patterson | |
| 3,066,739 A | * | 12/1962 | Saurenman | 166/141 |
| 3,141,534 A | * | 7/1964 | Dunston | 52/165 |
| 3,270,511 A | | 9/1966 | Colie | |
| 3,375,670 A | * | 4/1968 | Stanley | 405/244 |

(Continued)

FOREIGN PATENT DOCUMENTS

EP 079875 2/1986

(Continued)

OTHER PUBLICATIONS

International Search Report issued Nov. 9, 2004 on PCT/US03/38768.

*Primary Examiner*—Jong-Suk (James) Lee
(74) *Attorney, Agent, or Firm*—Banner & Witcoff, Ltd.

(57) ABSTRACT

Apparatus and an associated method for forming a pier in a soil matrix includes a hollow tube with a restricted expansion section connected to and adjacent a soil penetrating bottom head element which is configured to facilitate discharge of pier forming material such as grout. An expansion device in the form of an expandable bladder or expandable mechanical device is positioned along a section of the length of the restricted expansion section. The hollow tube structure is inserted into a soil matrix with the expansion device in the retracted condition. Subsequently, the expansion device is expanded to enlarge the formed cavity in the soil matrix. Then grout or other pier forming material is injected into the cavity as the expansion device is retracted or deflated and as the hollow tube structure is raised incrementally to form a pier with one or more uniquely shaped lifts.

6 Claims, 7 Drawing Sheets

U.S. PATENT DOCUMENTS

| | | | | | |
|---|---|---|---|---|---|
| 3,479,829 | A | | 11/1969 | Goodman | |
| 4,045,966 | A | * | 9/1977 | Rusche | 405/240 |
| 4,230,425 | A | | 10/1980 | Gusev et al. | |
| 4,334,345 | A | | 6/1982 | Jenks | |
| 4,411,557 | A | * | 10/1983 | Booth | 405/238 |
| 4,547,106 | A | | 10/1985 | Lipsker | |
| 4,768,900 | A | * | 9/1988 | Burland | 405/244 |
| 5,202,522 | A | | 4/1993 | Williams | |
| 5,219,249 | A | | 6/1993 | Junsheng et al. | |
| 5,249,392 | A | | 10/1993 | Houston et al. | |
| 5,249,892 | A | | 10/1993 | Fox et al. | |
| 5,256,004 | A | | 10/1993 | Gemmi et al. | |
| 5,549,168 | A | | 8/1996 | Sadler et al. | |
| 6,354,768 | B1 | | 3/2002 | Fox | |
| 6,402,432 | B1 | * | 6/2002 | England et al. | 405/232 |
| 6,425,713 | B1 | | 7/2002 | Fox et al. | |
| 6,942,429 | B1 | * | 9/2005 | Beck et al. | 405/236 |

FOREIGN PATENT DOCUMENTS

| | | | | |
|---|---|---|---|---|
| GB | 2157750 | * | 10/1985 | |
| JP | 56003714 A | | 1/1981 | |
| JP | 03008999 | * | 1/1991 | 405/133 |
| SU | 649789 | | 5/1979 | |
| WO | 1994/023135 | | 10/1994 | |

* cited by examiner

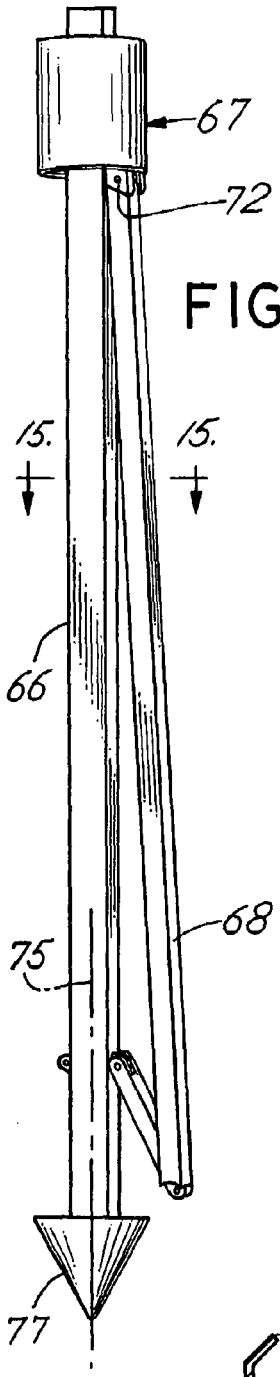
FIG.14
FIG.16
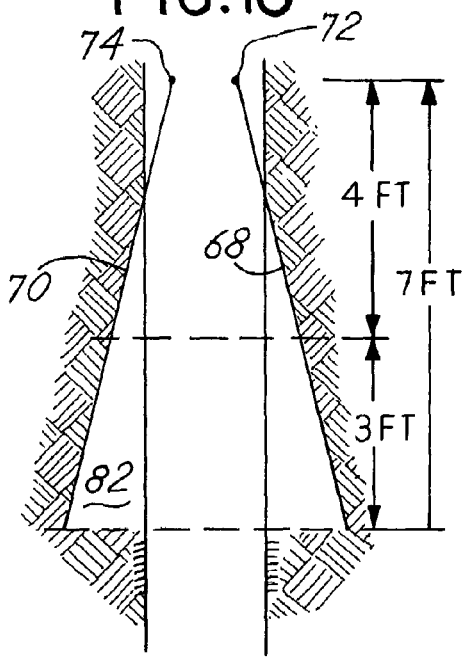
FIG.17
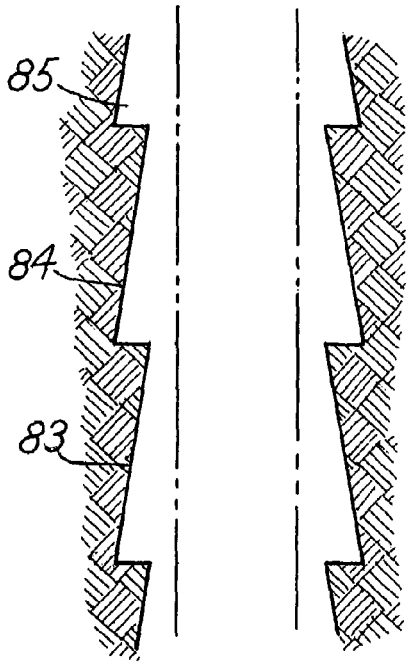
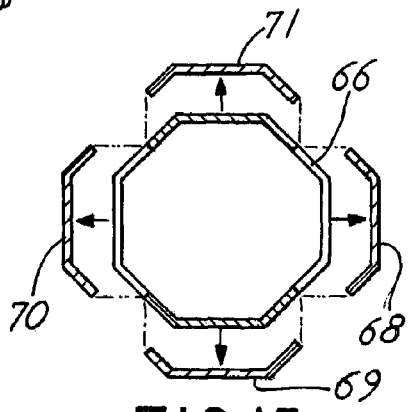
FIG.15

METHOD FOR CONSTRUCTION OF PIERS IN SOIL AND A PIER CONSTRUCTION

This application is a national stage of PCT/US03/38766 filed Dec. 5, 2003 and based upon U.S. Ser. No. 60/431,269 filed Dec. 6, 2002 under the International Convention.

BACKGROUND OF THE INVENTION

In a principal aspect the present invention relates to a method and apparatus for forming piers in various types of soil for the purpose of supporting a structure. The apparatus comprises an elongate, hollow tube structure with a shaped bottom head element and a mechanism for lateral expansion of a section of the hollow tube element adjacent the head element.

In U.S. Pat. No. 5,249,892, incorporated herewith by reference, a method and apparatus are disclosed for producing short aggregate piers in situ. The process includes forming a cavity in soil typically by a drilling process and then introducing successive layers of compacted aggregate material into the cavity to form a pier that can support a structure. The layers or lifts of aggregate are compacted during the pier forming process by means of a tamping device and typically have a diameter of 1–3 feet and a vertical rise of similar dimension.

U.S. Pat. No. 6,354,768, incorporated herewith by reference, discloses another method and apparatus for improving the stiffness of soil to support a structure. This method employs placement of an expandable member such as a bladder in the soil and subsequently expanding the bladder by pumping grout into it to compact the adjacent soil. The expandable member filled with grout or other material from the casing in the soil to serve as a pier.

U.S. Pat. No. 6,425,713, incorporated herewith by reference, discloses yet another methodology and apparatus for installation of a support pier. This patent generally discloses placement of a hollow casing in the soil and then removing material from the casing by means of a drill. Aggregate is then placed within the casing and the casing is manipulated to compact the aggregate to form a support pier.

While all of the foregoing methods and apparatus are considered to be useful for the formation of piers, there has remained the need to provide a method which will quickly and effectively enable construction of piers in multiple types of soils, including clay soils.

SUMMARY OF THE INVENTION

Briefly the invention comprises a method and apparatus for forming support piers in soils, such as soft to firm clays, for the purpose of supporting a structure such as a building foundation or roadway. The apparatus comprises an elongate hollow tube structure which is formed with a shaped end or bottom head element. The hollow tube structure is designed to carry grout or other pier forming material for discharge adjacent and above the shaped bottom head element. An expandable member mechanism is provided along a section of the hollow tube structure near the bottom head element. The expandable member mechanism generally encircles at least part of the hollow tube structure above the shaped bottom head element and is maintained in an unexpanded condition until the hollow tube structure is placed, driven or forced into a soil matrix. In a first embodiment, this expandable member mechanism is an inflatable bladder. In a second embodiment, this expandable member mechanism is a mechanical expansion device. The mechanical expansion device may be comprised of plates that are pushed outwardly from the hollow tube structure to compact the surrounding soil matrix.

Thus, in use, the hollow tube structure is first pushed into soil such as clay, though it may be placed into a pre-formed hole drilled in the soil. The bottom head element serves as a leading end for insertion into a soil matrix. The expandable member mechanism, either the expandable bladder or the mechanical expansion device, is connected to a manifold through which gas or liquid may be injected to cause expansion of the expandable member mechanism outwardly from the sides of the hollow tube structure following insertion into the soil. In an alternative embodiment, a mechanical drive is utilized to expand and contract the mechanical expandable member mechanism. The expansion of the expandable member mechanism causes lateral enlargement of the initially formed cavity in the soil matrix caused by pushing the hollow tube with the shaped bottom head element into the soil matrix. In addition to causing lateral enlargement of the cavity, to permit subsequent enlargement of a pier element formed in the cavity, expansion of the expandable member mechanism causes compaction of adjacent soil matrix and imparts lateral stresses onto the adjacent soil matrix. The expandable member mechanism is then caused to return to its unexpanded condition. Grout and/or other pier forming material is then pumped through the hollow tube structure to infiltrate into the cavity formed by the expandable member mechanism as the expanded mechanism is contracted. Connections are provided to a source of grout feeding through the hollow tube structure. The hollow tube structure is next relocated within the soil matrix typically by raising the hollow tube structure as grout or pier forming material is discharged into the cavity vacated by that structure.

The grout that is fed through the hollow tube structure is typically a cementitious grout with primary ingredients being cement, water, sand, and optional additives such as fly ash or other additives that may be utilized to improve the capacity or engineering characteristics of the formed pier. Combinations of these materials may also be utilized in the process.

The hollow tube structure with the expandable member mechanism is typically positioned in the soil matrix by pushing and vibrating the hollow tube structure having the leading end, shaped bottom head element into the soil with an applied vertical or axial static force vector and optionally, with accompanying dynamic force vectors. If a hard or dense layer of soil is encountered, the hard or dense layer may be penetrated by pre-drilling the layer to form a cavity or passage through which the hollow tube structure with the expandable member mechanism may be directed. The soil which is displaced by pushing and vibrating the hollow tube structure with the shaped bottom head element leading end, is generally displaced and compacted laterally into the pre-existing soil matrix. The hollow tube structure with the expandable member mechanism may also be positioned in the soil matrix by lowering the apparatus in a pre-drilled hole.

The hollow tube structure is typically constructed from a constant diameter tube and may include a bulbous bottom head element with an internal valve mechanism at or near the shaped bottom head element leading end. The hollow tube structure is thus generally cylindrical with a constant, uniform external diameter. Connected to the hollow tube above and adjacent the bottom head element is an expansion section which comprises the expandable member mechanism.

The bulbous bottom head element is also generally cylindrical and has an external diameter greater than the hollow tube with the expandable member mechanism. The bottom head element also typically is concentric with the hollow tube portion adjacent to the head element. The head element may also be configured to facilitate soil penetration such as by having a conical shape at the lower, leading end.

The apparatus may also include means for positioning an uplift anchor member within a formed pier or a tell-tale mechanism for measuring the movement of the bottom of the formed pier upon loading, such as during load testing. Such ancillary features are introduced into the formed pier when forming the pier and prior to setting of the cementitious grout or other pier forming material.

Thus, it is an object of the invention to provide a special hollow tube structure apparatus with a hollow tube having a special designed expandable member mechanism on a section and a special shaped bottom head element which may be used to create a larger and stronger pier in a reinforced surrounding soil matrix.

Yet another object of the invention is to provide an improved method and apparatus for the formation of subsurface, expanded piers, particularly subsurface piers formed in weak soils, including clays, sands and silts.

It is a further object of the invention to provide an improved method and apparatus for forming subsurface, expanded piers for support of building, foundations, embankments, retaining walls, storage tanks, and the like.

Another object of the invention is to provide a uniquely constructed subsurface, expanded pier comprised of incremental sections of grout or other pier forming material surrounded by sections of compacted and laterally stressed adjacent soils. Yet another object of the invention is to provide an improved method and apparatus for forming an expanded pier of grout that may include a multiplicity of additives, including fly ash, hydrated lime or quicklime, and other additives to improve the engineering properties of the matrix soil as well as the formed pier.

Yet another object of the invention is to provide an expanded pier construction method which is capable of being utility in many types of soil and which is capable of pier formation at greater depths and at greater speeds of construction than prior pier construction methods. Another objective of the invention includes providing a mechanism, method and apparatus for displacement and reinforcement of soil below a surface line in a quick and efficient manner wherein the equipment has simplicity of design, will remain available for use and can be easily maintained. The cost of the apparatus, thus, is low while the efficiency and operability of the apparatus is significantly high.

These and other objects, advantages, benefits and features of the invention will be set forth in the description which follows.

BRIEF DESCRIPTION OF THE DRAWINGS

In the detailed description which follows, reference will be made to the drawing comprised of the following figures:

FIG. 14 is an isometric view of another alternative mechanical expandable member mechanism;

FIG. 15 is a sectional view of the mechanism of FIG. 14 along the line 15—15;

FIG. 16 is a schematic view of the cavity formed by the mechanism of FIG. 14; and FIG. 17 is a schematic view of the pier formed by using the mechanism of FIG. 14.

DESCRIPTION OF THE PREFERRED EMBODIMENTS

Figure 1:
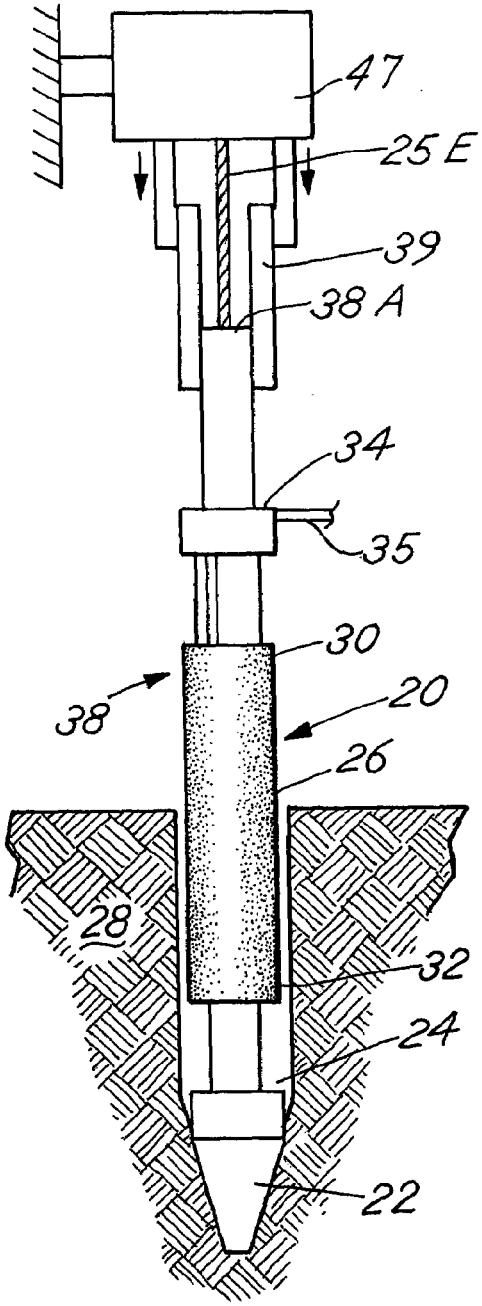
FIG. 1 is a schematic, elevation view of the component parts of one embodiment of the pier-forming apparatus employed in the practice of the invention.

Referring to the figures, particularly FIG. 1, the apparatus of the invention comprises, in a first preferred embodiment, a hollow tube structure 38 which is an elongate, typically cylindrical, uniform diameter pipe 38A having an expansion section 20, an adjacent bottom head element 22 at its lower end and a mandrel connection element 39 at its upper end. The hollow tube structure 38 is attached to the bottom head element 22 so that a discharge opening or passageway 24 is provided at or near the top of the bottom head element 22. The diameter of the bottom head element 22, at its widest extent, preferably exceeds the maximum diameter of the hollow tube structure 38 as well as a bladder 26 attached to the outside surface of the expansion section 20. This enables the structure 38 to be driven into a soil matrix in a manner whereby the bottom head element 22 will provide a protective passageway or form a cavity in the soil 28 that enables the hollow tube structure expansion section 20 including the attached bladder 26 to move downwardly, as described hereinafter, without unnecessarily abrading or tearing the bladder 26 or otherwise damaging the apparatus.

The bladder 26 is attached on the outside surface of the expansion section 20 at the opposite ends 30, 32 thereof and is inflatable. The bladder 26 includes a manifold or connection 34 for fluid line 35 to the interior of the bladder 26 so that the bladder 26 may be inflated by pressurized air, gas or fluid via bladder inlet 36. The bladder 26 may be a smooth surfaced material which is elastic. Alternatively, the bladder 26 may be constructed of a pleated, expandable fabric. Thus, various optional bladder 26 designs are possible. An optimum range of pressure for effecting bladder 26 inflation in clay-type soils is in the range of 50 pounds per square inch to 200 pounds per square inch. The bladder 26 material should be capable of such pressurization without tearing.

The material used to inflate the bladder 26 may, for example, be a fluid material, such as vegetable oil, which will not impact adversely upon the environment in the event the bladder 26 should fracture, tear or degrade. Hydraulic oil, gas or other materials may also be used depending upon the particular environment involved.

The hollow tube structure or tube 38 provides a passageway for grout or other soil improvement or pier-forming material to flow through the tube 38 including the expansion section 20 of the tube 38 around which the bladder 26 is formed, for ultimate discharge through grout discharge opening 24 adjacent to or incorporated in the bottom head element 22.

The hollow tube structure 38 includes a mandrel mechanism or yoke 39 at its upper end for connection to a device 47 such as a crane or pile type machine or derrick for driving the tube 38 downwardly into the soil 28. Thus, the upper end may include a yoke construction 39, or some other construction, which enables connection thereof to a driving and retraction mechanism 47.

Figure 2:
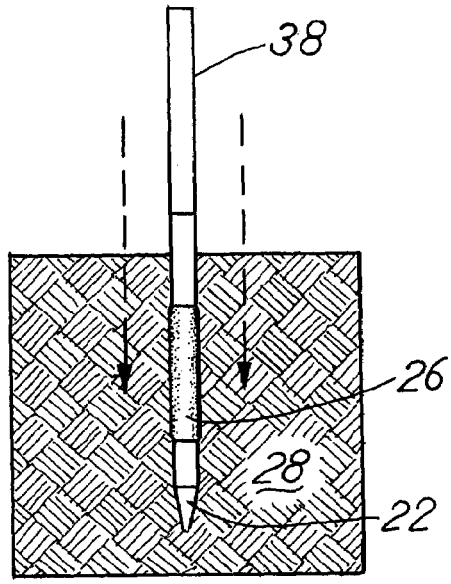
FIG. 2 is a schematic view of an initial step in the method of operation for forming a pier utilizing the apparatus of FIG. 1.
Figure 3:
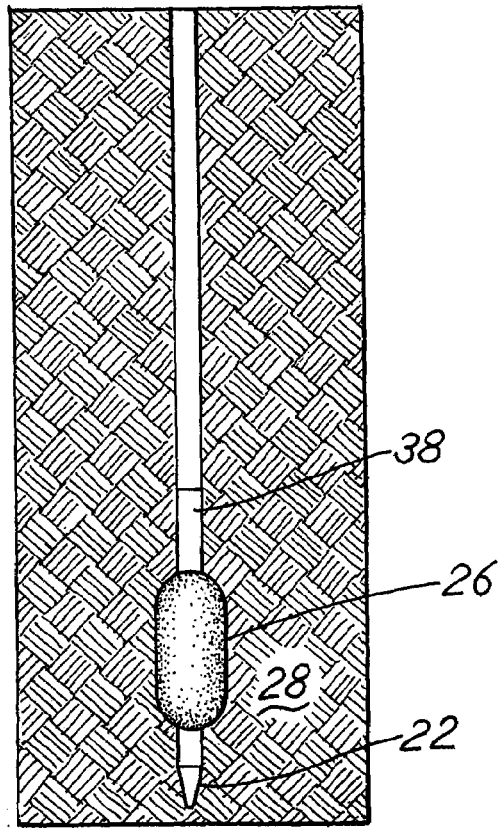
FIG. 3 is a schematic view illustrating a further step in the utilization of the apparatus of FIG. 1.

FIGS. 2–6 illustrate the manner of use of the first embodiment. Initially, the hollow tube structure 38 is pushed downwardly into the soil 28 with the bladder 26 in the uninflated condition. This is illustrated in FIG. 2. The hollow tube structure 38 is pushed downwardly to a lowest or bottom position in soil associated with the bottom of a pier being formed. Next, as illustrated in FIG. 3, the bladder 26 is inflated at a predesignated pressure to an expanded volume, using a liquid pump or gas compressor, to thereby compact or compress adjacent soil 28. The gas or liquid flow is injected through the manifold 34 connected to fluid source lines 35. The manifold 34, thus, is concentric with the hollow tube structure 38 that is driven into the ground 28, and directs fluid material into the bladder 26 which surrounds the hollow tube structure 38 driven into the ground 28. In this manner, the bladder 26 becomes at least partially inflated.

Figure 4:
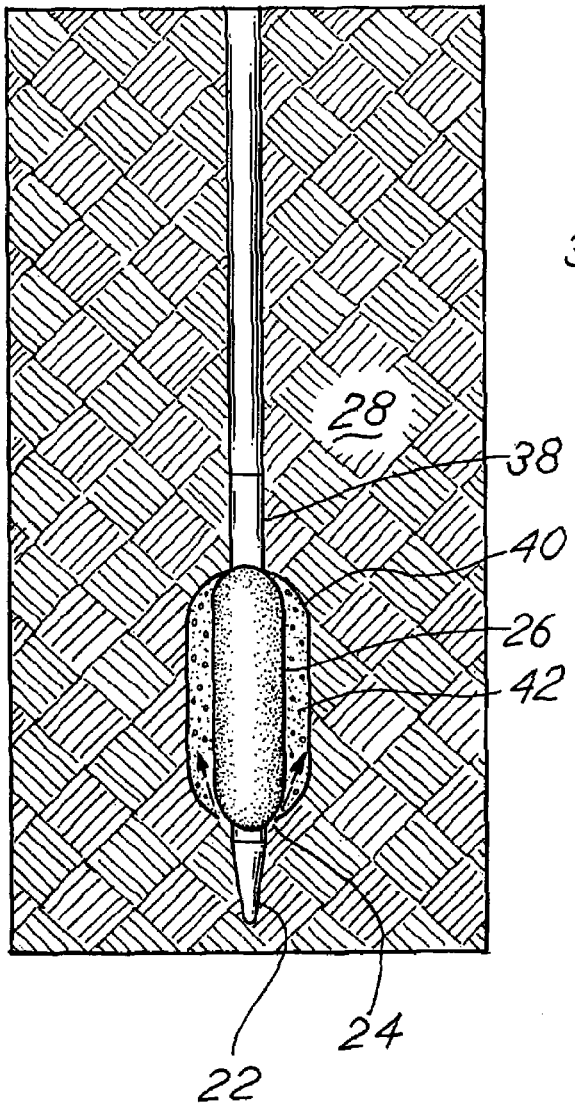
FIG. 4 illustrates yet a further step in the practice of the method using the apparatus of the invention.
Figure 5:
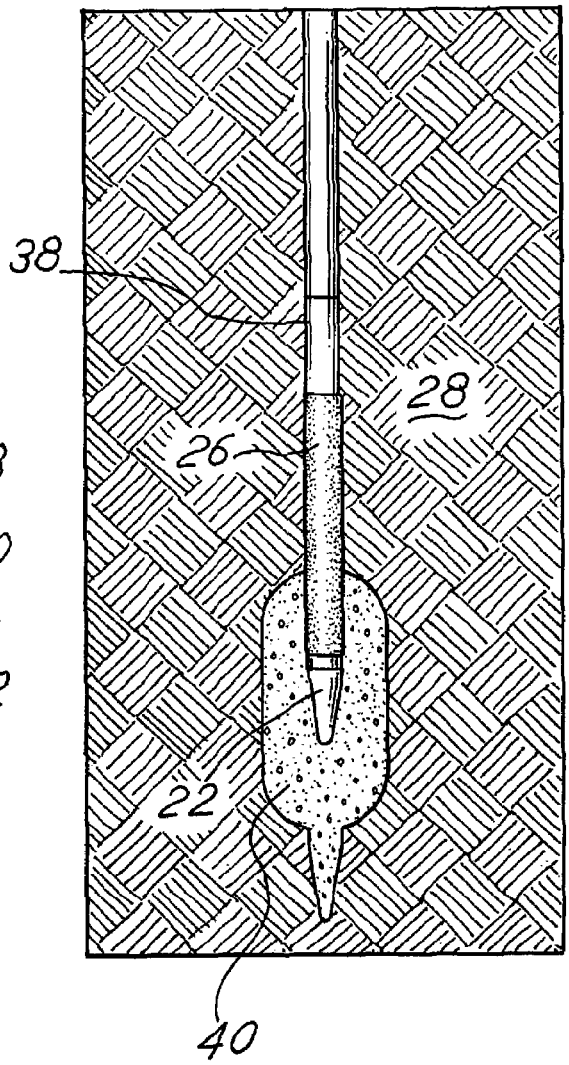
FIG. 5 illustrates a further step in the practice of the invention.

Next, as shown in FIG. 4, the bladder 26 is deflated as grout or other pier-forming material 42 is fed via opening 24 into the cavity 40 created by the shrinkage of the bladder 26 and/or raising of the hollow tube structure 38. The cavity 40 is thus filled while the bladder 26 deflates. The pathway of the grout or other pier-forming material is through the hollow tube structure 38 and then through opening 24 in or adjacent the attachment of the bottom head element 22 of the apparatus to the bladder expansion section 20. Subsequently, as depicted in FIG. 5, the hollow tube structure 38 is raised an incremental distance, for example, three feet. The incremental distance is typically associated with the length of the bladder 26. The entire process is then repeated. Namely, the bladder 26 is inflated. Subsequently, the bladder 26 is deflated after having compressed or compacted the surrounding soil 28. As the bladder 26 is deflated, additional grout material 42 or other pier-forming material 42 is injected into the region which the bladder 26 has vacated in the compressed soil. The region of the cavity below head element 22 is also filled with pier forming material 42 as the tube structure 38 is raised incrementally.

The aforesaid steps are repeated until an entire pier is constructed from a subsurface bottom level to ground level. The pier may then be capped and a foundation, or building, or structure may be placed thereon.

Figure 6:
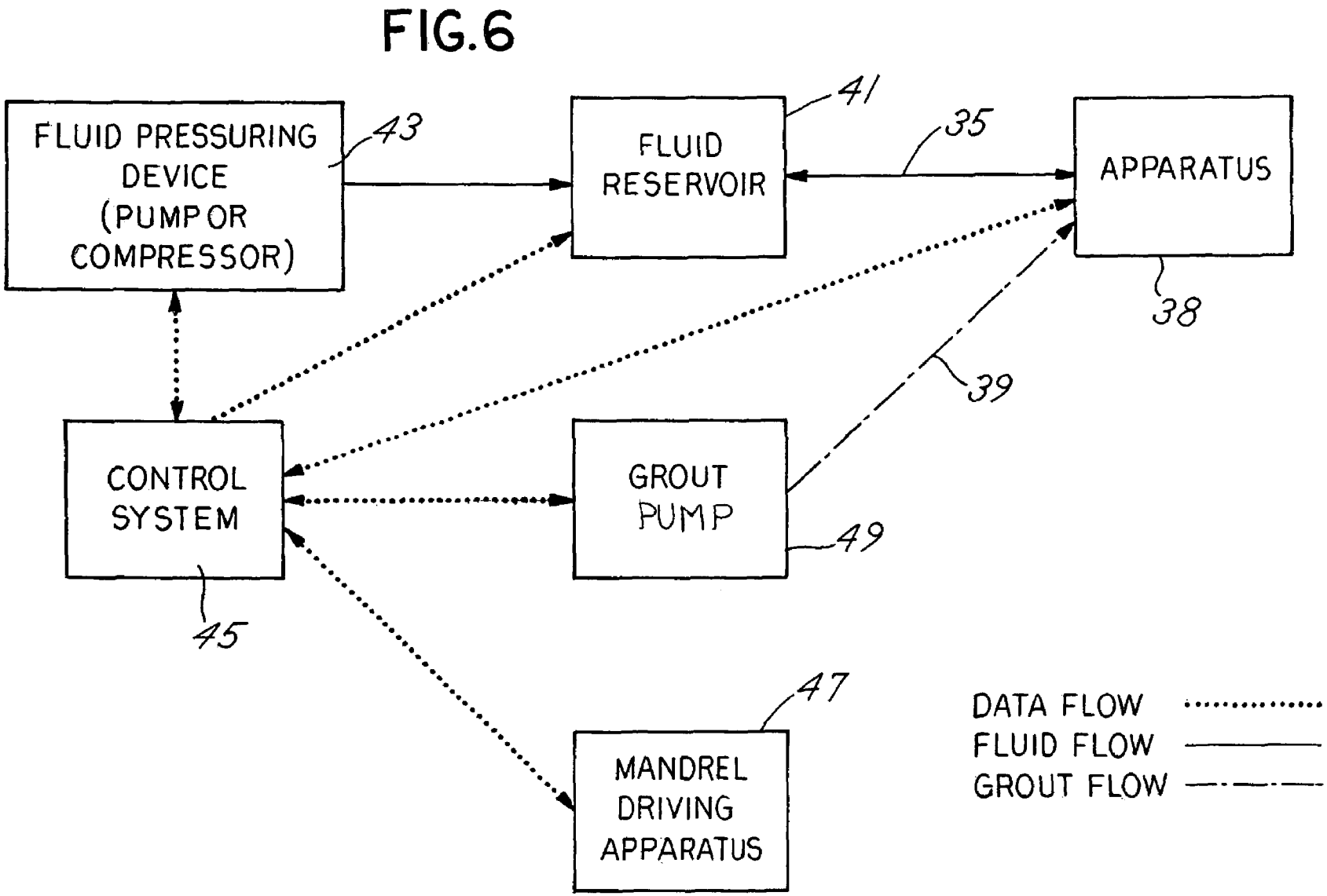
FIG. 6 is a logic flow diagram illustrating the manner of operation and control of the apparatus when practicing the method of the invention.

FIG. 6 illustrates diagrammatically the equipment configuration associated with the apparatus and method of the invention. The hollow tube structure 38 is connected to both a grout pump 49 and a fluid reservoir 41. A pump device 43 for providing pressure for the fluid in the fluid reservoir 41 to thereby inflate the bladder 26 is further provided. All of the elements of the combination are controlled by a control system 45. As an initial step, inasmuch as the tube structure 38 is driven into soil 28 to a prescribed depth, a hollow tube structure 38 driving apparatus 47 is utilized. The same driving apparatus 47 may be used to incrementally raise the tube structure 38.

The hollow tube structure 38 as depicted in FIG. 1, is preferably driven downwardly into soil 28 at a penetration rate upwards of 50 feet per minute. The pumps 39 used to pump the grout material or materials which fill the cavity formed by the bladder 26, will pump in the range of 50 cubic yards per hour. The bladder 26 inflation and deflation system pumps 43 will operate at a rate of at least about 1 gallon per second. The control system 45 provides for automatic control of the hollow tube structure 38 driving speed and position, the pressure of the grout or filling material, the rate of grout flow, the pressure of fluid into the bladder 26 and fluid flow rates and temperature.

Among the features of the apparatus which are variable are the structure of the bottom head element 22. The bottom head element 22 functions to accomplish soil 28 penetration and minimize soil 28 disturbance yet be durable. Materials which are preferred for the construction of head element 22 include stainless steel or high strength steel. Desirably the bottom head element 22 is removably attached to the end of the hollow tube structure 38 below the expansion section 20 and associated expansion mechanism to permit ease of disassembly for repair or change. The apparatus further includes means to direct the grout as well as the fluid material appropriately around the bladder 26 or into the bladder 26 as the case may be and as schematically illustrated in FIG. 6.

Figure 7:
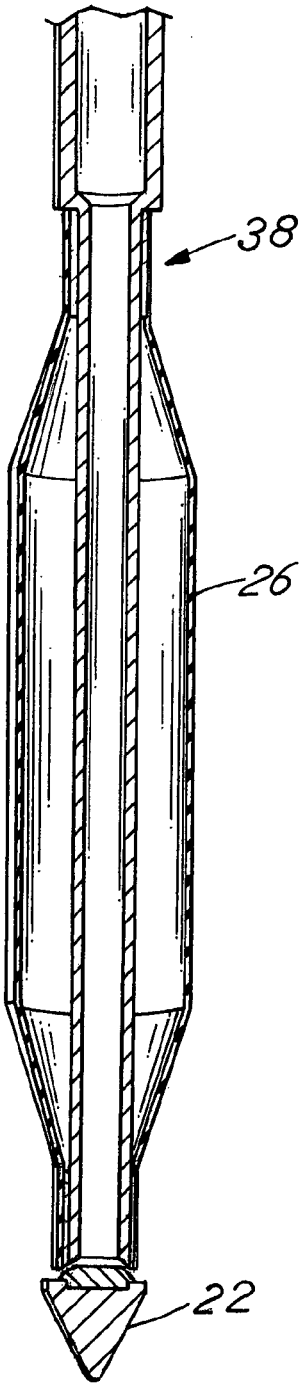
FIG. 7 is a schematic view of a hollow tube section with an inflatable bladder mechanism contained within a restricted expansion section. Attached to the restricted expansion section is the shaped bottom head element.
Figure 8:
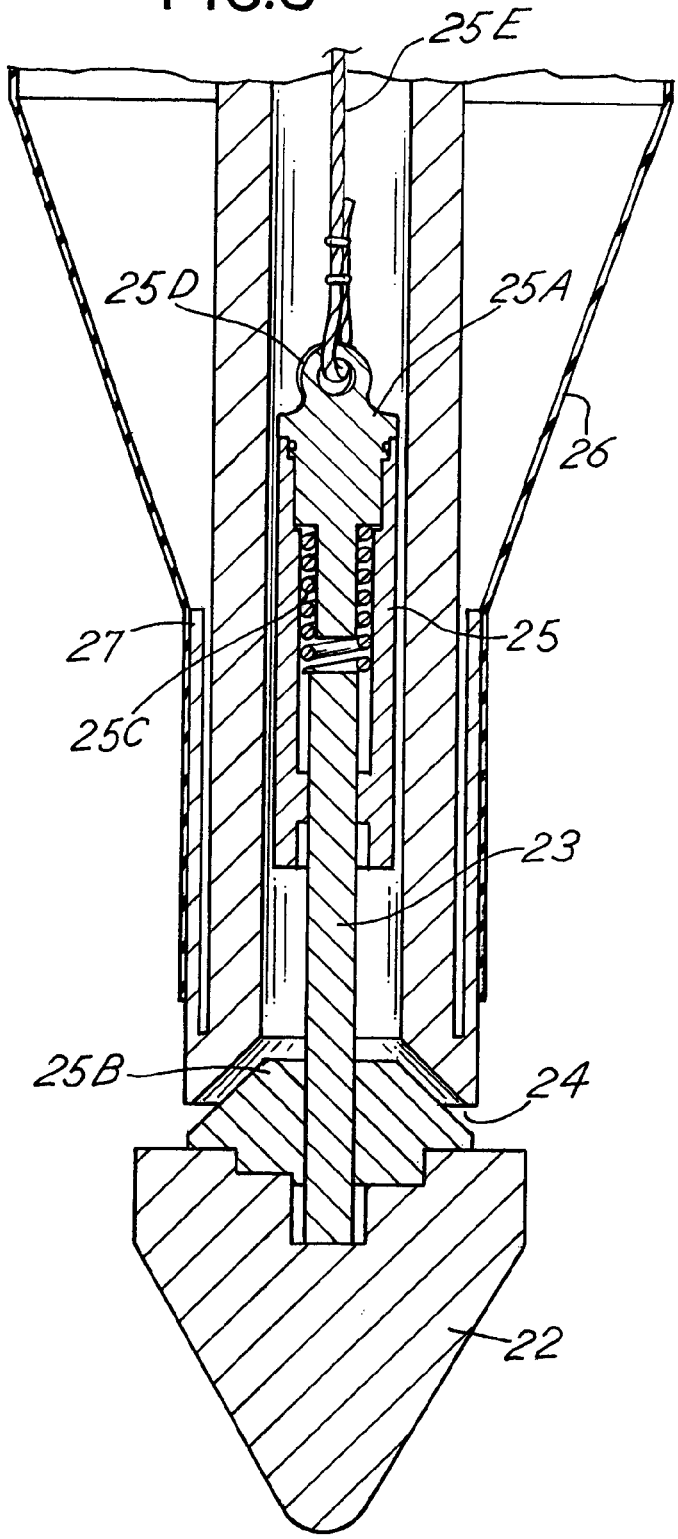
FIG. 8 is an enlarged sectional view of the shaped bottom head element of the hollow tube structure of FIG. 7.
Figure 10:
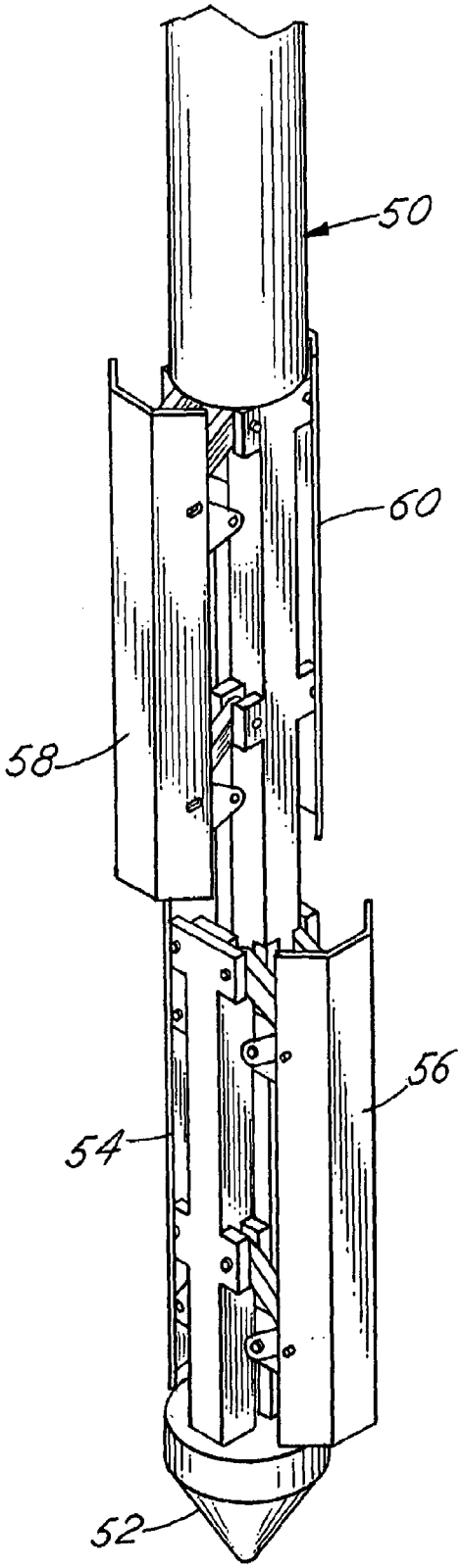
FIG. 10 is an alternate view of the construction of FIG. 9.
Figure 9:
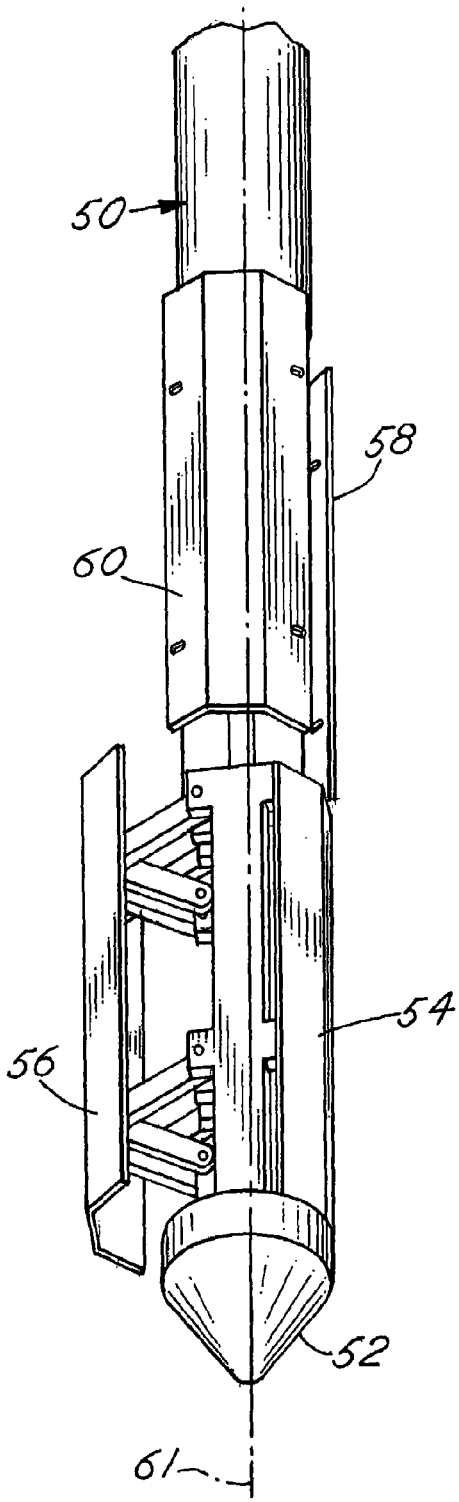
FIG. 9 is a schematic, isometric view of a bottom head element connected to an alternative expandable member mechanism mounted on a restricted expansion section which is attached to the hollow tube structure apparatus.

FIGS. 7 and 8 are further schematic diagrams depicting a construction of the hollow tube structure 38, bladder 26 and bottom head element 22 in combination. The bottom head element 22 may be mounted on a slidable rod 23 mounted in a housing 25 centered near the distal or lower end of tube structure 38. The rod 23 may be actuated to open a fluid or grout passageway 24 leading from the interior of the hollow tube structure 38. Thus, grout will flow around the housing 25 and around the drive rod 23 which manipulates the bottom head element 22 so as to open the passageway 24 when desired. That is, grout pressure on the piston head 25A of rod 23 is combination with grout pressure on the annular face 25B of the inside of head element 22 will overcome biasing force of a spring 25C to open grout passage 24. The piston head 25A includes an attachment ring 25D to which a cable 25E may be attached and pulled to retract the tube structure 38 from soil 28.

The bladder 26 is retained on the restricted expansion section 20 of tube structure 38 by means of a collar 27. A collar 27 is preferably provided at both ends 30, 32 of the bladder 26 and a manifold 34 provides a passageway 35 to the interior of the bladder 26 so that the bladder 26 may be appropriately inflated. The longitudinal dimension of the bladder 26 may be varied in accord with needs associated with the creation of a pier. For example, the bladder 26 may have a three feet longitudinal length. When the bladder 26 is inflated, the amount of inflation may increase the dimension transverse to the longitudinal axis of the hollow tube mandrel 20 by as much as 50% or more thereby compressing the soil 28 surrounding the device. The pressure exerted by the bladder 26 on the soil matrix 28 is adjustable, and the amount of expansion of the bladder 26 will depend on bladder geometry and soil 28 compression and strength characteristics.

In operation, as previously described, the hollow tube structure 38 and bottom head element 22 are inserted or driven or pushed into the soil 23 with the bladder 26 in the relaxed condition. The bladder 26 is then expanded. Subsequently, grout 42 is fed through the grout passageway 24 as the bladder 26 is deflated. The entire assembly may also be raised as the bladder 26 is deflated or once the bladder 26 is deflated to fill the region or cavity 40 where the bladder 26 and tube structure 38 were located. Grout 42 may thus then be injected into the region 40 vacated by the movement of the hollow tube structure 38 upwardly in the formed cavity 40. The sequencing and movement of the bladder 26 and tube structure 38 in the soil matrix 28 can be altered or adjusted so as to form a pier having multiple bulges or sections formed by the bladder 26 as the bladder 26 is inflated, deflated and incrementally lifted. Consequently, a rather complex pattern of lifts or sections of a pier can be formed by means of the device described and the movement of the hollow tube structure 38 as well as the inflation and deflation of the bladder 26, and the flow of grout or other pier forming material can be programmed to create any one of the variety of unique pier configurations or shapes. The length of each lift may be the length of bladder 26, or a lesser length or a greater length.

FIGS. 9–17 disclose an alternative to an inflatable bladder 26 expandable member mechanism for the formation of complex cavity configurations within a soil matrix 28 which, in turn, results in the creation of a support pier having a unique configuration or shape especially designed and compatible with a soil type. Thus, for example, referring to FIGS. 9–13, there is illustrated a device which utilizes a mechanical expandable member mechanism in lieu of a bladder 26 in order to compact soil 28 and form a cavity. A hollow tube structure 50 includes a bottom head element 52. A section of the tube structure 50 adjacent the bottom head element 52 includes a first set of panel members 54 and 56 and a second set of axially adjacent panel members 58 and 60. The panel members 54 and 56 are designed to move radially outwardly and away from the centerline axis 61 of the expansion section of the tube structure 38 so as to compress and compact the soil 28 adjacent thereto. One or both of the lower panel members 54 and 56 may be moveable outwardly from the centerline axis 61. In similar fashion, one or both panels 58 and 60 may move outwardly to create a unique cavity configuration within the soil 28. The hollow tube structure 38 is hollow and the bottom head element 52 is designed to direct grout or pier forming material in a manner similar to the embodiment depicted in FIGS. 1–8 into a cavity formed as the plates or panel members 54 and 58 are withdrawn to their nesting position against the hollow tube structure 50.

Figure 11:
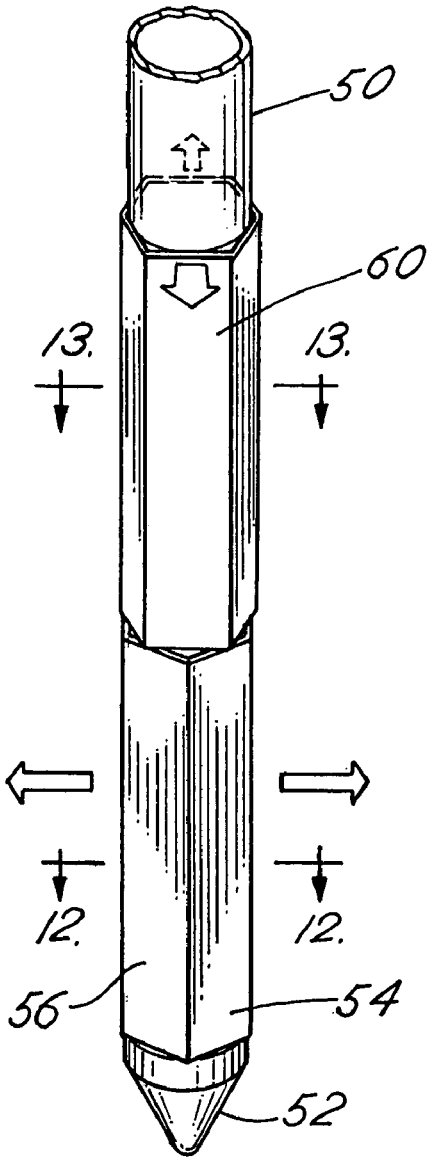
FIG. 11 is a schematic view of the mode of operation of the mechanism of FIG. 10.
Figure 13:
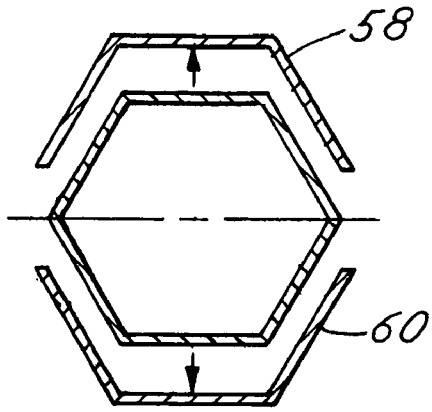
FIG. 13 is a sectional view of FIG. 11 taken long the line 13—13.
Figure 12:
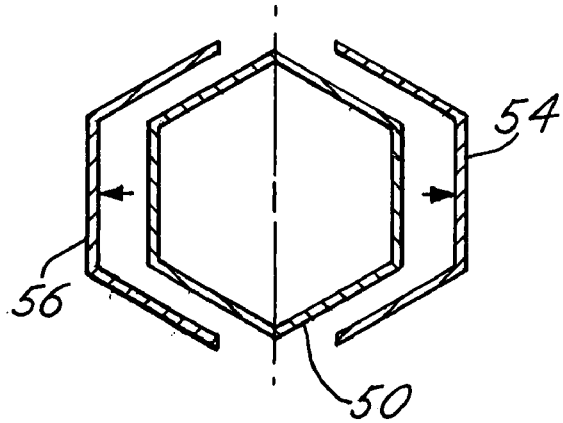
FIG. 12 is a sectional view of FIG. 11 taken along the line 12—12.

As depicted in FIGS. 11, 12 and 13, the plates or panel members 54 and 56 may move in a first radial direction from the centerline axis 61 of the restricted expansion section and the second set of plates 58 and 60 or panel members may move radially outwardly in a radial direction which is at right angles to the movement of the plates 54 and 56. As a result of such movement, the cavity formed within the soil may have a cross section that appears to be a cruciform shape when it is filled with grout and viewed in a top plan view. Unique additional shapes may be formed depending upon the configuration and shape of the plates 54, 56, 58 and 60 and also depending upon the angle of movement of those plates with respect to one another. Additionally, the plates 54, 56, 58, 60 may be programmed to move toward and away from the hollow tube structure 50 in a manner which creates a unique cavity shape as the hollow tube structure 50 is raised from its lowest position. The hollow tube structure 50 may additionally be rotated incrementally about its vertical axis 61 as it is raised. All of these features are variable and again can be programmed to create a uniquely shaped and uniquely sized pier within a soil matrix 28, depending upon the vertical movement of the hollow tube structure 50, the lateral movement of the plates 54 and 56, 58 and 60, the configuration of the plates 54, 56, 58 and 60, and the orientation of the plates 54, 56, 58 and 60 relative to each other. As a consequence, it is possible to develop a pier size and configuration which is uniquely suited for a particular soil matrix.

FIGS. 14–17 illustrate yet another construction utilizing a set of mechanical plates attached to a restricted expansion section 66 of a hollow tube structure 67. Thus, the restricted expansion section 66 of hollow tube structure includes first and second expansion plates 68 and 70 which pivot cantilever fashion respectively about a pivot connection 72 and 74 outwardly from the centerline axis 75 of the restricted expansion section 66. As a result, a V-shaped cavity is formed within the soil matrix 28 above a bottom head element 77. As depicted in FIG. 15, the number and configuration of the plates may be varied. In the embodiment depicted, four plates 68, 69, 70, 71 having a collapsible configuration in the form of an octagon are mounted on the restricted expansion section 66 and may form a unique cavity shape within a soil matrix 28 when pivoted about their pivot connection ends. The shape of the cavity is depicted schematically in a section in FIG. 16. Thus, if the plates 68–71 have a length, for example, of six feet and are moved outwardly in the range of 8–12 inches by virtue of a mechanical linkage mechanism 80 connecting the individual plates 68, 69, 70, 71 to the restricted expansion section 66, a frustoconical cavity is formed. The cavity 82 formed in this manner may be filled with grout and pier forming material as the hollow tube structure 67 is raised in coordination with expansion and contraction of the plats 68, 69, 70, 71, flow of pier forming material or grout, and rotation (if any) of the structure 67 to form (for example) a pier having a general configuration such as depicted in FIG. 17 comprised of a series of formed lifts 83, 84, 85. Again, programming of the motion of the hollow tube structure 67 as it moves vertically upward in the soil 28 as well as the inward and outward movement of the cantilever pivotal plates 68–71 will determine the ultimate configuration of a formed pier. Programming movement will enable custom design of piers depending upon the particular soil configurations.

While there is described preferred embodiments of the invention, the invention is limited only by the following claims and equivalents thereof.

What is claimed is:

1. A method for building a pier in a soil matrix and simultaneously reinforcing soil matrix surrounding said pier comprising the steps of:

a) driving a hollow tube apparatus into said soil matrix to a desired depth by applying a static force on the upper end of said apparatus in the range of about 5 tons to 20 tons, said hollow tube apparatus characterized by a hollow tube with a shaped bottom head element for driving as a leading end probe into the soil matrix, a material discharge opening at the lower end of the hollow tube above the head element, said head element configured to provide simultaneous axial and axially transverse stress components in the surrounding soil matrix, said apparatus further including a bladder expansion section with a lateral expansion bladder positioned on the outside of the hollow tube above the bottom head element and above the material discharge opening, said hollow tube apparatus characterized by having the head element with a maximum diameter exceeding the unexpanded diameter of the bladder;

b) expanding the bladder laterally away from the sides of the hollow tube to compact and displace the soil matrix adjacent thereto, said bladder characterized by generally circumferential walls fitted around the hollow tube and expandable beyond the maximum diameter of the head element;

c) subsequently reversing the expansion of the bladder;

d) lifting the hollow tube apparatus an incremental distance less than the distance of the desired depth while injecting solidifiable pier formation material into the region evacuated by the hollow tube apparatus and expanded bladder by discharging said material in a fluid flow through the material discharge opening into said evacuated region; and repeating sequentially steps b), c) and d) to form a pier of multiple vertically arranged incremental sections of solidified pier formation material extending upwardly from the desired depth, each section surrounded by compacted and laterally stressed soil matrix.

2. The method of claim 1 including the additional step of providing vertical vibration and axial dynamic forces to supplement the static force.

3. The method of claim 1 including the step of placing an axial rod in the cavity formed by the hollow tube apparatus for subsequent use as an uplift anchor member.

4. The method of claim 1 including the step of placing a sleeved axial rod with a bottom plate for subsequent use as a tell-tale for measuring bottom movement of the pier during load testing, said rod positioned in the formed pier and extending upwardly through the pier.

5. Apparatus for construction of a soil reinforcement pier in a soil matrix comprising, in combination:

an elongate hollow tube having a longitudinal axis, a closed top, a material entrance adjacent the top, a shaped bottom head element with a generally conical leading end, for driving into a soil matrix, and a material discharge outlet adjacent and above the bottom head element;

said shaped bottom head element at the bottom end configured to provide axial and transaxial stress components simultaneously onto the soil matrix surrounding the bottom head element as said head element is driven, said shaped bottom head element having a maximum circumferential dimension;

a fluid feed mechanism for directing fluid material into the material entrance and through the hollow tube and from the discharge outlet; and an expansion bladder mounted on the outside of a lower portion of the elongate hollow tube and above the head element and discharge outlet, said bladder being expandable from the outer side of the hollow tube to displace the soil matrix, to transmit lateral pressure to adjacent soil matrix and for compressing, compacting and dislocating the soil matrix while causing buildup in adjacent lateral soil stresses, resulting in a larger formed cavity within the axial length of the bladder, said expansion bladder characterized by having an unexpanded condition with a diameter less than the maximum diameter of the head element and an expanded condition greater than the maximum diameter of the head element, said fluid discharge outlet positioned between the head element and bladder expansion section in the hollow tube.

6. The apparatus of claim 5 including means for selectively closing and opening fluid flow through the discharge outlet.

* * * * *